United States Patent [19]

Thomas, Jr.

[11] Patent Number: 4,768,778

[45] Date of Patent: Sep. 6, 1988

[54] EXERCISING DEVICE

[76] Inventor: Robert S. Thomas, Jr., 1552 Point San Pedro Rd., San Rafael, Calif. 94901

[21] Appl. No.: 879,933

[22] Filed: Jun. 30, 1986

[51] Int. Cl.[4] ..... A63B 21/00

[52] U.S. Cl. ..... 272/93; 272/143; 272/132; 272/146

[58] Field of Search ..... 272/143, 93, 146, 132, 272/128

[56] References Cited

U.S. PATENT DOCUMENTS

| | | | |
|---|---|---|---|
| 3,134,591 | 5/1964 | Conn, Jr. et al. | 272/146 |
| 3,784,193 | 1/1974 | Simsian | 272/146 |
| 4,461,473 | 7/1984 | Cole | 272/143 X |
| 4,610,448 | 9/1986 | Hill | 272/143 |
| 4,611,807 | 9/1986 | Castillo | 272/132 |

OTHER PUBLICATIONS

*Double Twist Wrist,* Marcy Catalog, 1970, p. 8.
Nautilus, "Sportsmate", 1979 Catalog, pp. 28 & 29.

*Primary Examiner*—Richard J. Apley
*Assistant Examiner*—J. Welsh
*Attorney, Agent, or Firm*—Douglas A. Chaikin

[57] ABSTRACT

An exercising device for doing a variation of a push-up exercise. The exercising device includes a base, a platform rotatably connected to the base having a plane of rotation, a support extending upwardly from the rotating platform, approximately perpendicular to the plane of rotation, and a handle removably connected to the support, the handle capable of rotation, independent of the support and the platform. And novel exercises using the above device.

23 Claims, 5 Drawing Sheets

EXERCISING DEVICE

FIELD OF THE INVENTION

This invention relates to physical exercising devices and more particularly to a mechanical exercising device having a rotating platform.

BACKGROUND OF THE INVENTION

Physical fitness, long neglected by modern man, has recently come to the forefront of present day consciousness as an essential ingredient in having a healthy and happy life. For many years the United States military as well as the military of other countries found the exercise known as "push-ups" to give particularly well rounded benefits. In fact it is said that a push-up utilizes nearly every muscle in the human body.

However, those practitioners of the push-up exercise occasionally experience pain in their wrists. The pain is caused from the "palms downward" position, which is typical during the push-up exercise. In the typical position the wrist is approximately perpendicular to the horizontal or floor surface, on which the practitioner pushes against in order to raise his body. This is an unnatural angle for the wrist. This unnatural position causes an uncomfortable pressure on delicate bones in the wrist, which are not meant to bear loads, such a substantial portion of a person's weight.

In addition, during the push-up exercise, it is a natural motion for the fists to twist simultaneously with the extension and retraction of the arms. A traditional push-up exercise does not allow this twisting motion and consequently the strain of resisting the natural motion must also be absorbed by the wrists.

Other types of push-ups have been developed which are designed to relieve some of the pressure created by the loading factor described above. Fist push-ups have been known to eliminate pressure on the wrist. However, a fist push-up requires the knuckles to bear at least a substantial portion of the load. The fist position can be exceedingly uncomfortable because the knuckles are also not meant to bear the load created by supporting and raising a substantial portion of a person's weight. Thus, the fist position may cause just as much pain as the "palms downward" position. Further, a fist push-up does nothing to eliminate the stress created by resistance to the natural twisting motion.

Another push-up position, known as the fingertip push-up position has also been developed to relieve the pressure against the wrist created by the palms downward position. In a fingertip push-up, the practitioner pushes off the floor or supporting surface using his fingertips. A substantial portion of the practitioner's weight is supported and raised by his fingertips. As can be appreciated, fingertips were similarly not meant to bear a person's weight. Thus, neither the fist nor the fingertip push-up substantially solve the practitioner's dilemma of doing the well-rounded exercise, push-ups, without placing a load on his body in an unwanted and perhaps unhealthy manner.

The lack of a proper push-up exercise has had a detrimental effect on people doing push-ups and gaining the positive benefits resulting from same. Thus, a need was created for an aide which could assist in providing the beneficial effects of push-ups without creating the harmful side effects. Various exercising devices were designed to meet this need. For example, Rice, U.S. Pat. No. 4,305,579 provided a rotating platform in combination with a stationary base having two posts with hand grips, a rotatable platform between the posts, adjustable weights upon the platform, two rotatable incline pads stationarily located on the platform for standing upon a head brace support on the post and a pull cord from the center of the platform causing it to rotate.

Still others have tried an isometric type of exercising device for approximating the kind of benefit achieved by push-ups. For example, Morrill Jr., U.S. Pat. No. 3,369,809 discloses a platform having at least one pulley journalled for rotation thereon and reeved with a length of rope, the free ends of the rope being connected to handle means adapted to be grasped by the user and pulled upwardly away from the platform to exert a tension on the rope in the performance of the exercises.

A planetary exerciser is disclosed in Palacios, U.S. Pat. No. 3,441,271, which has a base for rotatable mounting on a major platform by means of an annular roller bearing. The opposite portions of the exposed surface of the major platform are adapted to receive and support the feet of the user. A pair of minor platforms are rotatably carried on opposite portions of the major platform by means of ball bearings. The minor platforms include foot receiving and supporting areas disposed on the exposed central surface portion of the minor platforms.

Another exercising device is disclosed in U.S. Pat. No. 4,077,626 which includes a bench mounted on a platform and adapted to provide a foot space on each side of the bench, a bar traversing said bench attached at its ends to a pair of lines, a linear to rotational motion converter operably attached to said lines and adapted to convert the linear expansion of the lines to the rotational motions and to rewind the lines when the extension is relaxed and a fly wheel responsive to the linear to rotational motion converter and adapted so the pulling of the lines results in the rotation of the fly wheel.

Still another body conditioning device is disclosed in Brandt et al, U.S. Pat. No. 3,936,047 which discloses a machine equipped with a rotating supporting platform and having the ability to tilt at an angle from the horizontal.

None of the above described devices assist in alleviating the strain on the delicate wrist bones and muscles occurring during the exercising event of a push-up. It was left to applicant to create a device which enhances the benefits of push-ups, while eliminating some of the principal faults.

SUMMARY OF THE INVENTION

It is an object of this invention to provide an exercising device which assists a user in doing push-ups.

It is a further object of this invention to provide an exercising device which encourages practitioners of push-ups to continue, while at the same time attracting new practitioners.

It is a further object of this invention to elevate the user above the floor to increase the beneficial effects of the push-up exercise.

It is a further object of this inventionh to provide a device which eliminates some of the load bearing pressure on the wrist during the push-up exercise.

It is a further object of the invention to provide an exercising device which assists the user in a natural punching motion of the fist, arm and shoulder during the push-up exercise.

It is a further object of this invention to provide a device which assists the practitioners of boxing and the martial arts in throwing a "fist-twisting" punch.

The exericising device which accomplishes the above objects comprises:

a base;

a platform rotatably connected to the base having a plane of rotation;

a support fixably attached to the platform extending along a first axis; and an elongated handle mounted to the support, the elongated handle extending along a second axis generally parallel to the plane of rotation of the platform, the support elevating the handle away from the platform.

In a preferred embodiment, the support is five inches long. The user then does his exercises from the elevated position of five inches increasing the exercising benefits and removing the load bearing stress from the delicate wrist bone structure.

In a further preferred embodiments, two exercising devices are connected by a band which is in the shape of a figure eight. The band provides greater resistance to twisting rotational movement, thus increasing the work necessary to do an exercising event. Thus, the overall benefits of the exercise are increased.

In still another preferred embodiment, the rotating platform includes a friction ring wrapped around it. The friction ring is adjustable and causes a resistance to rotation. In a similar manner to the immediately above described embodiment, this preferred embodiment increases the overall benefits of the exercise.

The exercising device in accordance with this invention has the advantage of allowing the user to follow the natural rotational movement of his body during the push-up exercise.

The exercising device in accordance with this invention has the advantage of being adaptable to a number of new exercises which will be especially advantageous to practitioners of fist twisting punches.

These and other objects and advantages of this invention will be clearer with reference to the description of the drawing below.

DETAILED DESCRIPTION OF THE INVENTION

Figure 1:
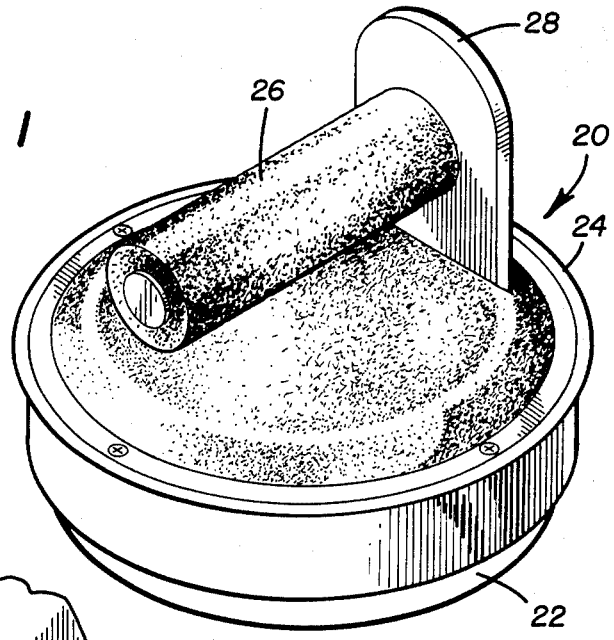
FIG. 1 is a perspective view of an exercising device in accordance with this invention.

The invention will now be described with reference to the drawings, wherein like reference characters designate like or corresponding parts throughout the several views and referring particularly to FIG. 1, there is shown a first preferred embodiment of the invention, an exercising device, generally indicated by the numeral 20. The exercising 20 includes a base 22, a rotating platform 24 and a handle 26 connected to the platform 24 by a support 28.

Figure 2:
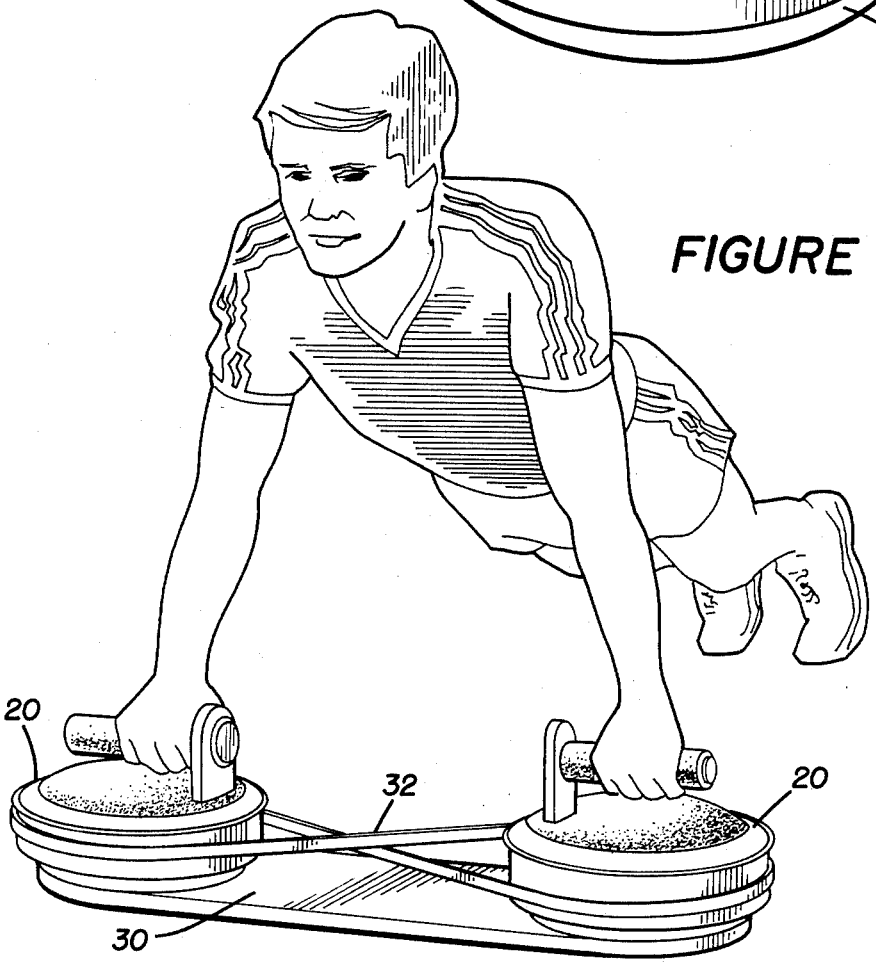
FIG. 2 illustrates a user, using a combination of two exercising devices in accordance with this invention.

FIG. 2 shows the exercising device in use. The user is exercising using a combination of the exercising devices 20. The exercising devices 20 keep their position relative to one another on a mounting board 30. As the user exercises, the platforms 24 are rotating in opposite directions relative to one another. During the extension of the arms, the right fist rotates counter-clockwise and the left fist rotates clockwise, this defines the extension portion of the cycle. During the release portion of the cycle or the retraction of the arms, the reverse is preferred, the right fist rotates clockwise and the left fist rotates counter-clockwise. The completion of the extension portion of the cycle and the release portion of the cycle define one cycle.

When the removable handle is used, the rotation of the platform remains the same. The handgrips are simultaneously rotated as the fists are twisted. During the extension of the arms, the knuckles of both hands are rotated away from the chest of the user. During retraction, the knuckles are rotated towards the users chest.

In the embodiment shown in FIG. 2, a band 32 is provided to cause an additional frictional force and increased exercise. The band 32 is connected to each of the devices 20. The band 32 inhibits the rotation of one platform with respect to the other as will be explained more clearly below. As shown in FIG. 2, the band 32 is preferably in the shape of a FIG. 8 which allows the platforms 24 to be rotated relative to one another, while still connected by band 32.

Figure 3:
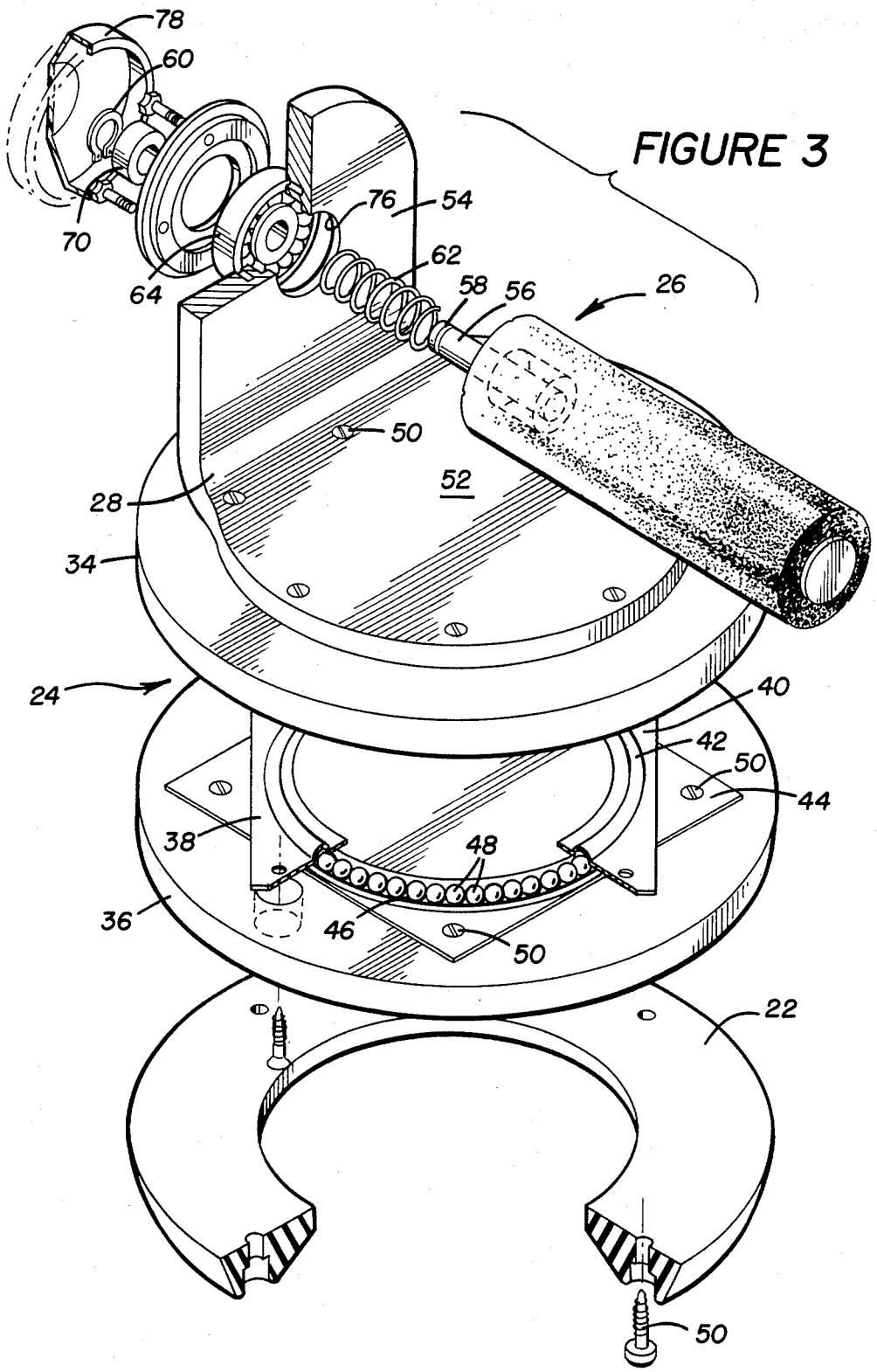
FIG. 3 is an exploded perspective view of the exercising device in accordance with this invention shown in FIG. 1.

FIG. 3 illustrates the internal workings of an exercising device 20 in accordance with this invention. The platform 24 includes an upper plate 34, a lower plate 36, and a bearing 38. The bearing 38 includes a first plate 40 having a raceway 42 which is a downwardly facing annular depression. The bearing 38 also includes a second plate 44 having a raceway 46. The raceway 46 is an upwardly facing annular depression. The raceways are aligned so that the upwardly and downwardly facing annular depressions are directly aligned with one another. Ball bearings 48 of appropriate size are fit within the annular depressions to allow the first plate 40 to rotate with respect to the second plate 44.

The base 22 is connected to the rotating platform 24 by the connection of the base 22 with the lower plate 36. The lower plate 36 is connected to the base 22 by fasteners 50. The lower plate 36 is connected to second plate 44 by additional fasteners 50. The same is true for the first plate 40 which is connected to upper plate 34 by additional fasteners 50.

The support 28 is pear-shaped and made from one half inch thick steel plate and is preferably between 5" and 12" or more in length. It will be of course be appreciated that a vast number of other materials could be used within the scope of this invention. The support 28 has a circular section 52 and an arch-shaped tang section 54 defining a stanchion. The tang section 54 is bent at an approximate 90 degree angle to the circular section 52 where the tang and support sections join. The circular section 52 has countersunk openings through which fasteners 50 are inserted. The support 28 is connected to the upper plate 34 by fasteners 50, which fit through the countersunk openings.

The thick steel plate is quite heavy. During exercise, the support 28, itself acts as an eccentric creating its own resistance to rotation. Additionally, since the tank section 54 is not centered on the circular section 52, it acts as an eccentric structure as the weight of the support is greater concentrated off center to one side of the platform as the platform 24 is rotated, being more in resistance at some portions of the rotation than at others.

The tang section 54 elevates the user's push-up position from the floor or supporting surface. In the embodiment shown in FIG. 3, the tang section 54 is 5" long, thereby elevating the user 5" above the floor. This enables the user to achieve a comfortable push-up position as well as get the maximum benefit from each exercising event.

Figure 4:
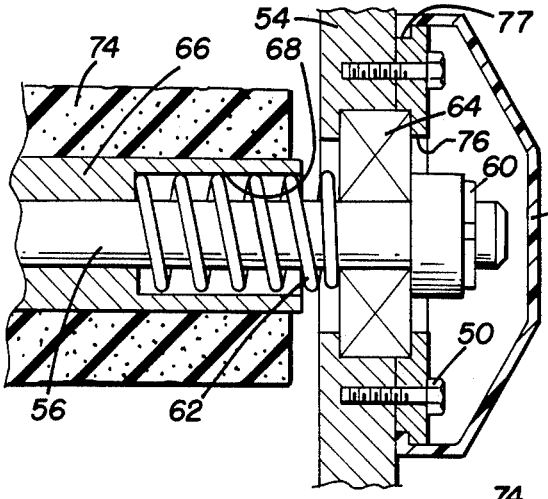
FIG. 4 is an enlarged cross-sectional view of a portion of the handle of the exercising device of FIG. 1.

The handle 26 will now be described with reference to FIGS. 3 and 4. The handle is removable from the support 28. The handle 26 includes a metal rod 56 which has a ½ inch outside diameter and is 6½ inches in length. The metal rod 56 has a notch 58 adapted to fit a retaining ring 60. The metal rod 56 is surrounded by a rubber hose 66 which has an annular opening 68. A spring 62 is mounted on the metal rod 56 and is abutted by the annular opening 68. A bearing 64 is located between the spring 62 and the locking ring 60. A spacer 70 is between the bearing 64 and the retaining ring 60. The spring exerts a pressure between the hose annular opening 68 and the bearing 64.

The support tang section 54 includes an opening 72 through which metal rod 56 is inserted. The bearing 64 rests against tang section 54 at opening 72 and thereby allows the handle 26 to rotate freely while being supported by support 28.

Figure 5:
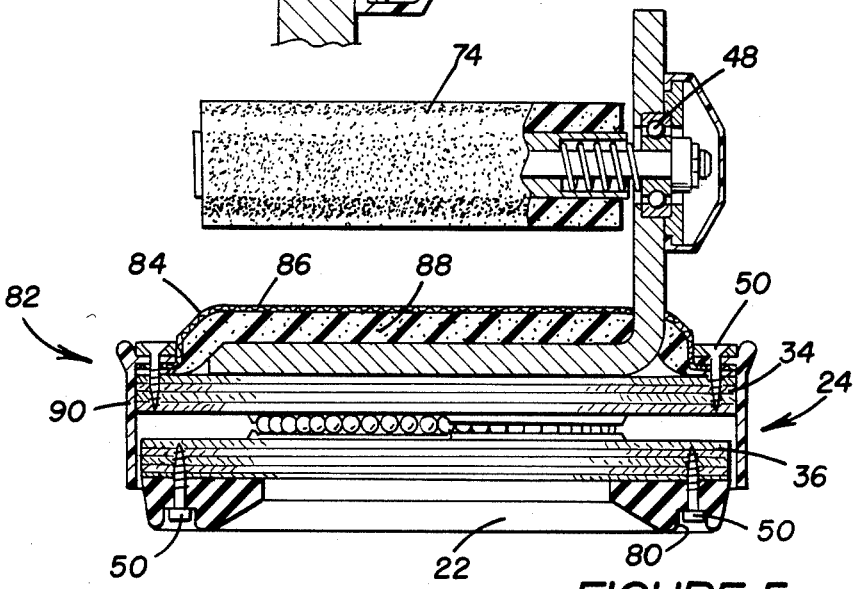
FIG. 5 is a partial cross-sectional view of the exercising device of FIG. 1.

The handle is covered with decorative trim 74 which serves to provide the user with an even more comfortable grip. An additional annular ring 76 is secured to the tang section 54 between bearing 64 and spacer 70. The annular ring 76 provides a means for mounting a cap 78 of decorative trim over the exposed portion the metal rod 56. The cap 78 is snapped onto annular ring 76 in grove 77. The bearing 64 is preferably a ball bearing as shown in FIG. 5.

It will be appreciated that if a circular clip is used in place of the ring 60, which is a snap ring, additional space will be needed for the user to pull off the retaining ring with his fingers. Using this alternate structure, the spacer 70 facilitates the removal of the handle 26 from the support tang section 54. The increased distance accommodates the finger tips of the user. It then becomes quite easy for the user to insert his fingers between the handle 26 and support tang section 54 to remove the retaining ring.

The further details of the rotating platform 24 and the base 22 will now be described with reference to FIGS. 5 and 6. The upper plate 34 and the lower plate 36 of the rotating platform 24 are made from wood in the embodiment shown. The base 22 is connected to the lower plate 36 by fasteners 50. The base 22 has recesses 80 in which the fasteners 50 fit. Thus fasteners 50 are completely enclosed within the base 22 and will not scratch the floor or supporting surface upon which the base 22 rests during exercising. The fasteners 50 shown in FIG. 5 are wood screws and screw into lower plate 36.

A decorative material 82 surrounds the rotating platform 24. The decorative material includes a top portion 84 made from non-slip padding 86 and a sponge material 88. The decorative material 82 also includes side skirts 90. The top portion 84 is laid over the top surface of the rotating platform 24 and the side skirts 90 are overlayed on the edge 92 of the top portion 84. Fasteners 50 are inserted through the top portion 84 and side skirts 90 onto the upper plate 34. The fasteners 50 includes a retaining ring 94 for holding the decorative material 82 securely to the rotating platform 24. The side skirts 90 include an annular raised ridge 96 for mating compatibly with the fasteners 50 and the retaining ring 94 for further securing the decorative material 82 to the rotating platform 24. It will further be appreciated that the side skirts 90 may be of a one piece construction within the spirit and scope of this invention.

Figure 6:
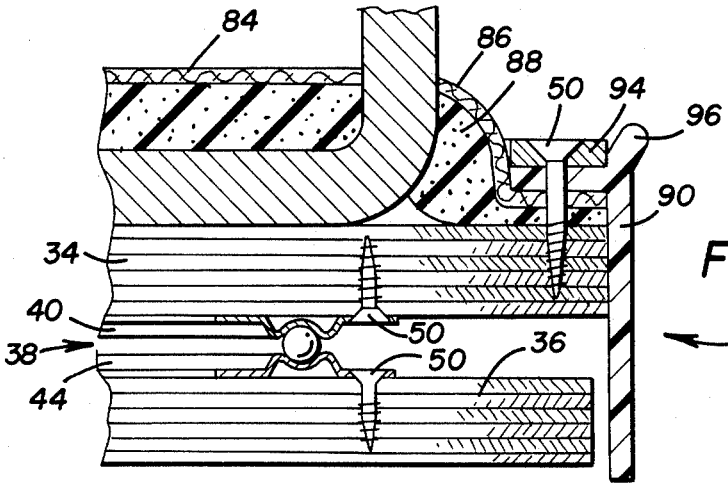
FIG. 6 is an enlarged cross-sectional view of a portion of the base support and platform of the exercising device of FIG. 1.

With particular reference to FIG. 6, there is shown the bearing 38 connected to the rotating platform 24. Fasteners 50 are inserted through the first plate 40 into the upper plate 34 of the rotating platform 24. Likewise, the second plate 44 is secured to the lower plate 36 by another fasteners 50.

Figure 7:
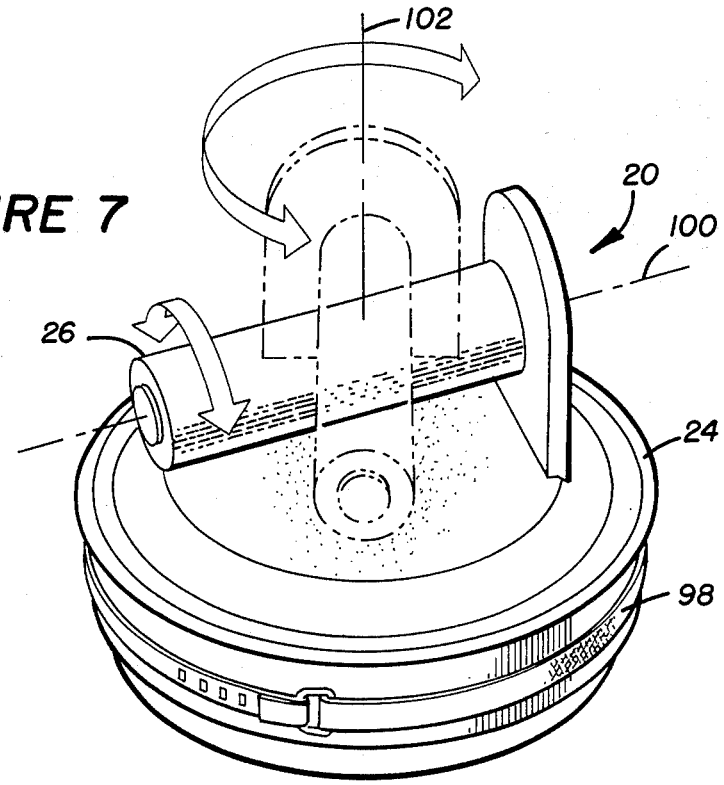
FIG. 7 illustrates a rotational movement of the handle and platform as well as illustrating an alternative embodiment of the exercising device in accordance with this invention.
Figure 8:
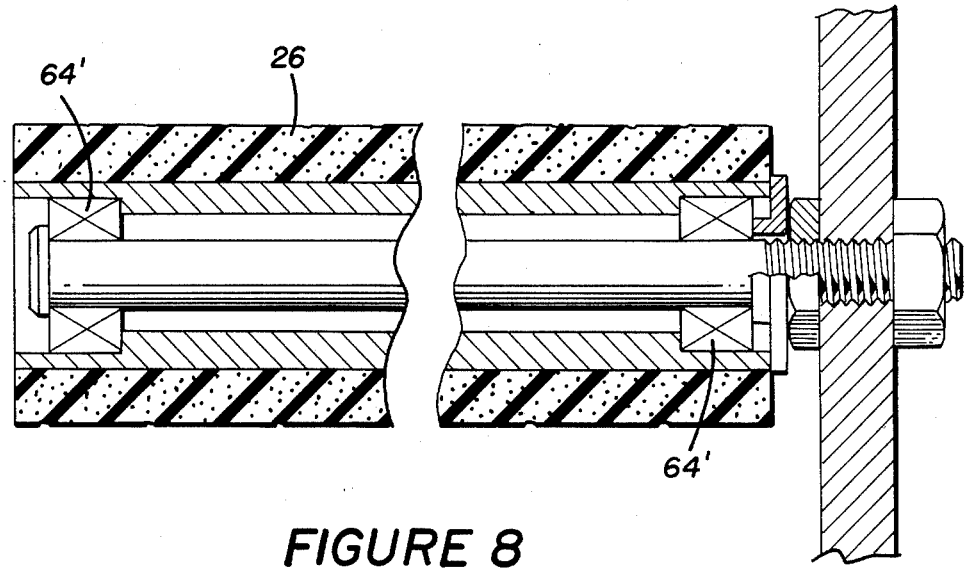
FIG. 8 is a cross-sectional view of an alternative embodiment of the handle in in accordance with this invention.

FIGS. 7 and 8 show additional embodiments of the exercising device in accordance with this invention. With particular respect to FIG. 7, there is shown the exercising device 20 including an additional friction ring 98. The friction ring 98 fits around the side skirts 90 of the rotating platform 24. The friction ring 98 is adjustable and can be adjusted so as to provide an inward force against the side skirts 90 and the lower plate 36. Since the rotation of the platform 24 depends upon the ability of the upper plate 34 to rotate with respect to the lower plate 36, such an inward pressure causes an additional frictional force to be created when the upper plate 34 rotates with respect to the lower plate 36. The additional frictional force provides an increase in the work necessary to rotate the platform 24 during an exercising event. Since the ring 98 is adjustable, the work necessary for each exercising event can be adjusted. In order to increase the frictional force and thereby the work required, the is friction ring 98 is tightened. It will thus be appreciated that the side skirts 90 are functional as well as decorative.

FIG. 7 also shows the rotational movement of the exercising device 20 with respect to the horizontal and vertical axis. As can be seen in FIG. 7, the handle 26 rotates around a horizontal axis 100. The rotating platform 24 rotates about vertical axis 102. The combination of rotations about the vertical axis 102 and horizontal axis 100 encourages optimization of exercise for each exercising event.

With particular respect to FIG. 8, there is shown an alternate embodiment 26 in accordance with this invention. In FIG. 8 the handle 26 includes a first and a second bearing 64'. In this embodiment, the combination of the two bearings 64' serve to spread the load created by the exercising of the user over two bearings. Thus, the maximum load required of the bearing 64' compared with bearing 64 is one-half. The remaining elements of the handle 26 shown in FIG. 8, function in the same manner as earlier described.

As stated previously, the handle 26 is removable. When the handle 26 is removed, the user may perform his push-up exercises directly on the top of the rotating platform 24. Thus, the user may perform a fingertip push-up on the exercising device 20, while rotating his wrists. This gives the user the benefit of being able to have natural wrist rotation, while performing the fingertip push-up. It will be readily appreciated that a fist push-up can also be done on the exercising device 20 in the same manner as a fingertip push-up, namely, by removing the handle 26. Similarly, the user is capable of achieving the benefits of natural wrist rotation in doing a fist push-up, while using the device 20

Figure 9:
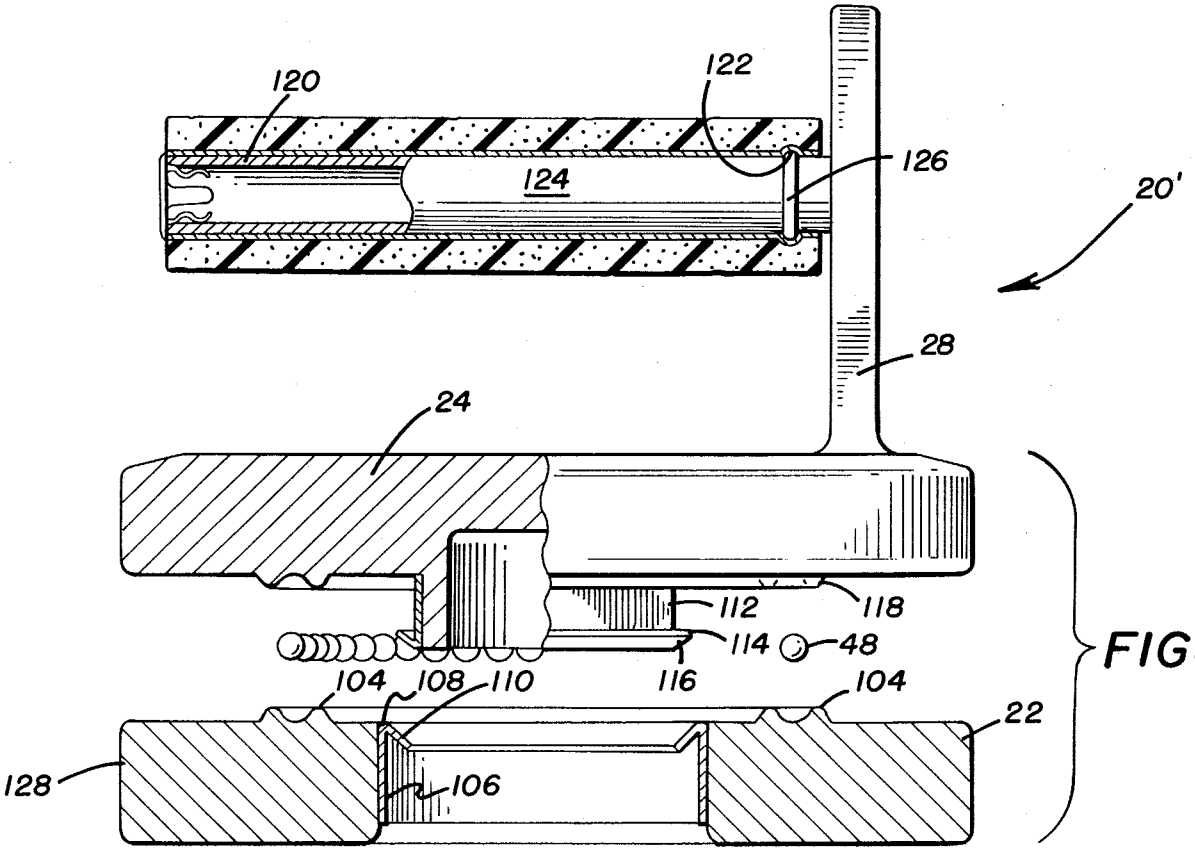
FIG. 9 is a side elevational view of an alternative embodiment of an exercising device in accordance with this invention.

FIG. 9 illustrates another embodiment of an exercising device in accordance with this invention, generally indicated by the numeral 20'. The device 20' includes base 22. The base 22 has a first extruded bearing raceway 104 which functions in the same manner as raceway 46. The base 22 has a center recess 106. The base 22 also has a first annular lip 108 extending into the recess 106. The lip 108 has a first bearing surface 110.

The exercising device 20' includes a rotating platform 24. The rotating platform 24 has a neck 112 for extending downwardly into the recess 106. The neck 112 has second annular lip 114 with a second bearing surface 116. When the device 20' is assembled, the first and second bearing surfaces, 110 and 116, respectively, make slideable contact with one another. The exercising device 20' has a second extruded bearing raceway 118 which aligns with first extruded bearing raceway 104. The second raceway 118 functions in the same manner as raceway 42. As described with reference to exercising device 20, ball bearings 48 fit between the first and second raceways 104 and 118, allowing the platform 24 to rotate with respect to base 22.

It will be appreciated that raceways 104 and 118 could be intruded into the rotating platform 24 as well as extruded therefrom.

The exercising device 20' includes a handle 26 comprising a hollow tube 120 having a notch 122. The handle 26 is connected to the support 28. The support 28 extends vertically from the rotating platform 24 and has a horizontally extending extension 124. The horizontal extension 124 has a rib 126. The hollow tube 120 slides over the horizontal extension 124 with the notch 122 sliding over the rib 126 such that the rib 126 and notch 122 are directly aligned. The combination of the rib 126 and notch 122 define a define a retaining structure to keep the handle 26 on the support 28. The hollow tube 120 is thus free to rotate on the extension 124 without falling off.

The base 22 and the sides of the base 128 are dipped in a rubber-like material to provide a non-slip area so that the device does not move during exercise. This makes for a smoother rotation of the platform under the load forces created by an exercising event. Additionally, the rubber coating adds to the decorative and generally aesthetically pleasing appearance of the exercising device 20'. Similarly the exterior of the hollow tube 120 is coated with a decorative sponge material which provides greater comfort for the users' hands as well as increasing the decorative appeal of the exercising device 20'.

While the instant invention has been described by reference to what is believed to the most practical embodiments, it is understood that the invention may embody other specific forms not departing from the spirit of the central characteristics of the invention. Particularly, the support need not be perpendicular to the floor or supporting surface, not does the handle need to be perpendicular to the support. It will be appreciated that the handle and the support could be at slightly greater or less than 90 degree angle and that structure would still fall within the scope of the invention. This applies to the single exercising device embodiment and the embodiment where two exercising devices are used, as shown particularly in FIG. 2. The number of support structures could also vary and there cold be a plurality of such structures. The present embodiments therefore should be considered in all respects as illustrative and not restrictive, the scope of the invention being limited solely to the appended claims rather than the foregoing description and all equivalents embraced thereto being intended to be embraced therein.

What is claimed is:

1. An exercising device, comprising:

a base;

a platform rotatably connected to the base having a plane of rotation, the platform adapted for being rotated in a first direction by the extension of a user's muscles and rotated back to its original position by the retraction of a user's muscles, a support connected to the platform and extending along a first axis, the support having a first portion defining a single stanchion, the stanchion being offset from the center of the platform and being generally perpendicular to the plane of rotation and the support having a second portion being approximately perpendicular to the first portion and covering a substantial portion of the platform for connection therewith, the support defining an eccentric structure for opposing the force which causes the platform to rotate; and an elongated handle mounted to the support, the elongated handle extending along a second axis generally parallel to the plane of rotation of the platform, the support elevating the handle away from the platform, whereby, the force needed to rotate the platform varies as the platform is rotated.

2. An exercising device as set forth in claim 1, wherein the handle is rotatable with respect to the support around the second axis.

3. An exercising device as set forth in claim 2, wherein the elongated handle includes an outer portion defining a hand grip portion and an inner portion defining a bar portion, the hand grip portion being rotatable with respect to the bar portion and the bar portion being fixedly mounted to the support.

4. An exercising device as set forth in claim 3, wherein the elongated handle is removable with respect to the support.

5. An exercising device as set forth in claim 2, wherein the handle is elevated less than twelve inches above the platform.

6. An exercising device as set forth in claim 2, wherein the handle is elevated at least twelve inches above the platform.

7. An exercising device as set forth in claim 2, wherein the handle is elevated five inches above the platform.

8. An exercising device as set forth in claim 2, wherein the elongated handle has an exterior surface which is covered with a non-slip padded material for gripping the handle.

9. An exercising device as set forth in claim 1, wherein the first axis makes less than a 90 degree angle with the plane of rotation of the support.

10. An exercising device as set forth in claim 9, wherein the first axis makes more than a 90 degree angle with the plane of rotation of the support.

11. An exercising device as set forth in claim 1, wherein the support is one-piece and the first and second portions are made of a heavy material from the family of steel or steel alloys.

12. An exercising device as set forth in claim 1, wherein the platform and the base include raceways and wherein ball bearings are held between the raceways for assisting the rotation of the platform with respect to the base.

13. An exercising device as set forth in claim 12, wherein the platform and the base include mating surfaces which comprise an annular lip for supporting rotational movement of the platform with respect to the base.

14. An exercising device as set forth in claim 1, wherein the platform is generally circular.

15. An exercising device as set forth in claim 14, wherein the platform has an exterior surface which is covered with decorative non-slip padding.

16. An exercising device as set forth in claim 1, wherein the base has a bottom portion having a means for discouraging movement of the base against a supporting surface.

17. An exercising device as set forth in claim 16, wherein the means comprises an annular ring having feet made of a rubber material contacting a supporting surface.

18. An exercising device as set forth in claim 17, wherein the base is made from a heavy weight material.

19. An exercising device as set forth in claim 18, wherein the base is made from metal.

20. An exercising device as set forth in claim 19, wherein the base is generally circular.

21. An exercising device, comprising:

a base;

a platform rotatably connected to the base having a plane of rotation, the platform adapted for being rotated in a first direction by the extension of a user's muscles and rotated back to its original position by the retraction of a user's muscles, the platform includes friction means wrapped around the exterior of the platform for causing the platform to rotate against a frictional force;

a support connected to the platform having a first portion defining a single stanchion, the stanchion being offset from the center of the platform, and being generally perpendicular to the plane of rotation and the support having a second portion being approximately perpendicular to the first portion and covering a substantial portion of the platform for connection therewith, the support defining an eccentric structure for opposing the force which causes the platform to rotate; and an elongated handle mounted to the support, the elongated handle extending along an axis generally parallel to the plane of rotation of the platform, the support elevating the handle away from the platform.

22. An exercising device as set forth in claim 21, wherein the platform has an exterior and the friction means is wrapped around the exterior of the platform.

23. An exercising device as set forth in claim 22, wherein the amount of friction is adjustable.

* * * * *